US011772848B2

(12) United States Patent
Fisher

(10) Patent No.: US 11,772,848 B2
(45) Date of Patent: Oct. 3, 2023

(54) CONTAINER WITH PUMP SYSTEM AND METHOD

(71) Applicant: Steve Fisher, Lancaster, PA (US)

(72) Inventor: Steve Fisher, Lancaster, PA (US)

( * ) Notice: Subject to any disclaimer, the term of this patent is extended or adjusted under 35 U.S.C. 154(b) by 0 days.

(21) Appl. No.: 17/460,840

(22) Filed: Aug. 30, 2021

(65) Prior Publication Data

US 2022/0063868 A1 Mar. 3, 2022

Related U.S. Application Data

(60) Provisional application No. 63/072,117, filed on Aug. 29, 2020.

(51) Int. Cl.

| | |
|---|---|
| ***B65D 25/38*** | (2006.01) |
| ***B65D 25/28*** | (2006.01) |
| ***B65D 21/02*** | (2006.01) |
| ***B65D 25/20*** | (2006.01) |

(52) U.S. Cl.

CPC ..... *B65D 25/38* (2013.01); *B65D 21/0209* (2013.01); *B65D 25/20* (2013.01); *B65D 25/28* (2013.01)

(58) Field of Classification Search

CPC .... B65D 25/38; B65D 21/0209; B65D 25/20; B65D 25/28; B67D 7/04; B67D 7/845; B67D 2210/00139

See application file for complete search history.

(56) References Cited

U.S. PATENT DOCUMENTS

| | | | | | |
|---|---|---|---|---|---|
| 2,300,243 | A | * | 10/1942 | Zierden | B65H 75/364 242/387 |
| 5,139,278 | A | * | 8/1992 | Vlasicak | B67D 7/845 220/86.1 |
| 5,472,124 | A | * | 12/1995 | Martushev | B65D 1/18 222/530 |
| 5,597,097 | A | * | 1/1997 | Morris | B67D 7/005 222/530 |
| 5,667,113 | A | * | 9/1997 | Clarke | B67D 7/845 222/530 |

(Continued)

FOREIGN PATENT DOCUMENTS

| | | | | | |
|---|---|---|---|---|---|
| EP | 1591412 | A1 | * | 11/2005 | B67D 7/0205 |
| GB | 2570921 | A | * | 8/2019 | B65D 1/023 |
| WO | WO-2021140305 | A1 | * | 7/2021 | B65D 1/18 |

*Primary Examiner* — Donnell A Long

(74) *Attorney, Agent, or Firm* — Jacob M. Ward; Ward Law Office LLC

(57) ABSTRACT

A container for dispensing a liquid can include a housing. The housing can have a top wall, a base, and side walls, which form a substantially cuboid shape and a substantially uniform rectangular cross-section. The housing further includes a reservoir forming a portion of an interior of the housing. The reservoir can be configured to store the liquid. An outlet can be formed in the housing and fluidly coupled to the reservoir. A pump can be disposed in the interior of the housing. The pump can be operable to transfer the liquid between the reservoir and the outlet. A method of operating the container for dispensing a liquid includes providing the container. The liquid reservoir portion can be filled. The container can be transported to a predetermined location. The hose can be positioned and the pump can be actuated. The container can then be stored.

11 Claims, 11 Drawing Sheets

(56) References Cited

U.S. PATENT DOCUMENTS

| | | | | |
|---|---|---|---|---|
| 7,293,587 | B1 * | 11/2007 | Broberg | A63H 17/00 141/98 |
| 2006/0086411 | A1 * | 4/2006 | Luca | B67D 7/84 141/284 |
| 2008/0264953 | A1 * | 10/2008 | Lowman | B67D 1/0406 220/592.19 |
| 2014/0261854 | A1 * | 9/2014 | Nemec | B67D 7/04 222/105 |
| 2019/0106314 | A1 * | 4/2019 | Shaw | B65D 85/84 |
| 2019/0248552 | A1 * | 8/2019 | Olarte | B65D 1/0261 |

* cited by examiner

CONTAINER WITH PUMP SYSTEM AND METHOD

CROSS-REFERENCE TO RELATED APPLICATIONS

This application claims the benefit of U.S. Provisional Application No. 63/072,117, filed on Aug. 29, 2020. The entire disclosure of the above application is incorporated herein by reference.

FIELD

The present disclosure relates to containers and, more particularly, containers for dispensing liquids.

INTRODUCTION

This section provides background information related to the present disclosure which is not necessarily prior art.

Certain portable fuel containers have traditionally been constructed and configured to permit stored fuel to be dispensed from an opening for use. Certain portable fuel containers are safe and effective for their intended purpose when properly used. Such containers typically include an elongated pour tube or spout for discharging fuel from the container and into a receiving tank, and a venting arrangement to promote fuel discharge from the container. The top wall of the container is provided with an opening, which opening forms both an inlet for receiving and refilling the container with fuel and an outlet for discharging fuel. In practice, one end of the pour tube is connected to the opening and fuel is discharged from the other end.

Typically, the vent arrangement of the container includes a closure cap that is snap-fitted into another opening formed in the container wall. Removal of the closure cap enables air to flow into the interior of the container to replace fluid being dispensed and enhance fluid flow through the pour tube. In use, the elongated pour tube is inserted into the opening of a receiving tank or other apparatus into which the fuel is to be transferred.

Portable fuel containers, however, can have various drawbacks. For example, the shape of a typical portable fuel container does not allow for many storage options. The containers consume space and are not able to be stacked. The portable fuel container can have one or more projections, including a dispensing nozzle, that can be broken off in use and in storage, which can lead to a dangerous fuel spill. Additionally, use of portable fuel containers can be burdensome. The containers can be heavy and hard to transport. Further, the operator must lift the container to a desired location to pour and dispense fuel therefrom.

There is accordingly a continuing need for a container for dispensing a liquid that can be easily stored and transported for end use.

SUMMARY

In concordance with the instant disclosure, a container for dispensing a liquid that can be easily stored and transported for end use, has been surprisingly discovered.

In certain embodiments, a container for dispensing a liquid can include a housing. The housing can have a top wall, a base, and side walls, which form a substantially cuboid shape and a substantially uniform rectangular cross-section. The housing further includes a reservoir forming a portion of an interior of the housing. The reservoir can be configured to store the liquid. An outlet can be formed in the housing and fluidly coupled to the reservoir. A pump can be disposed in the interior of the housing. The pump can be operable to transfer the liquid between the reservoir and the outlet.

In certain embodiments, a method of operating a container for dispensing a liquid includes providing the container. The container can include a housing. The housing can have a top wall, a base, and side walls, which form a substantially cuboid shape and a substantially uniform rectangular cross-section. The housing further includes a reservoir forming a portion of an interior of the housing. The reservoir can be configured to store the liquid. An outlet can be formed in the housing and fluidly coupled to the reservoir. A pump can be disposed in the interior of the housing. The pump can be operable to transfer the liquid between the reservoir and the outlet. The liquid reservoir portion can be filled. The container can be transported to a predetermined location. The hose can be positioned and the pump can be actuated. The container can then be stored.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
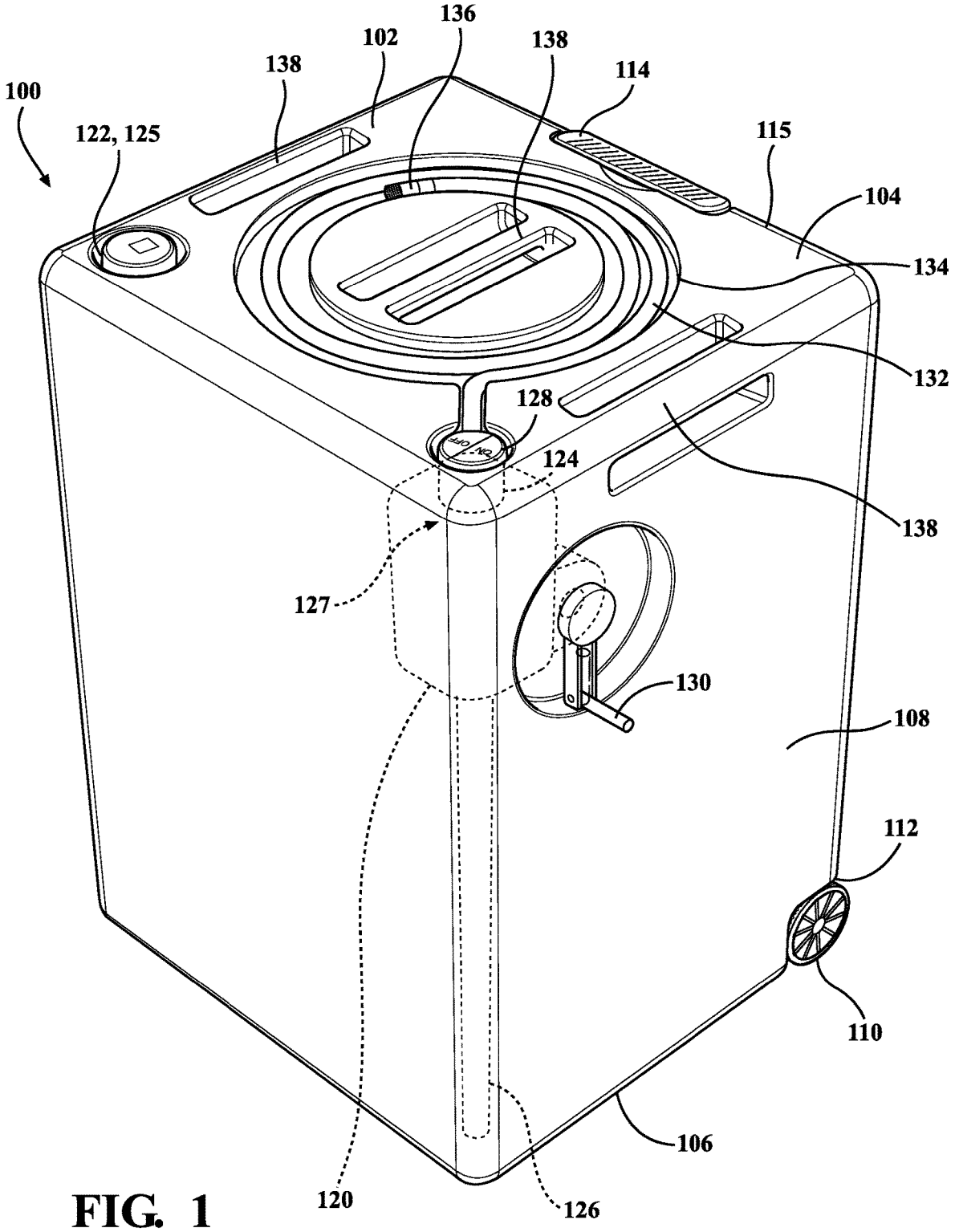
FIG. 1 is a front perspective view of a container for dispensing a liquid, according to one embodiment of the present disclosure.
Figure 2:
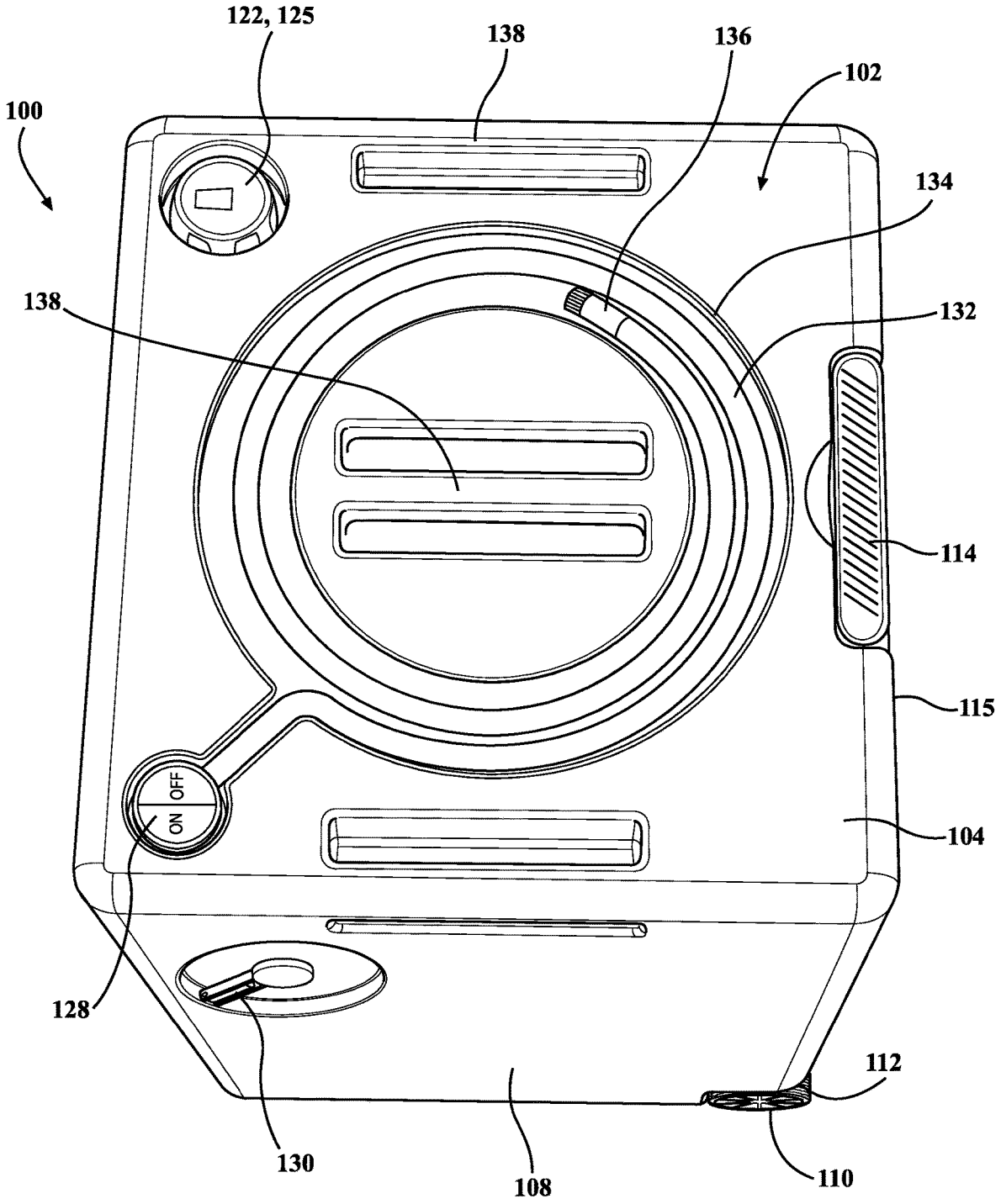
FIG. 2 is a top perspective view of the container shown in FIG. 1.

The following description of technology is merely exemplary in nature of the subject matter, manufacture and use of one or more inventions, and is not intended to limit the scope, application, or uses of any specific invention claimed in this application or in such other applications as can be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items can be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that can arise from ordinary methods of measuring or using such parameters.

Although the open-ended term "comprising," as a synonym of non-restrictive terms such as including, containing, or having, is used herein to describe and claim embodiments of the present technology, embodiments can alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that can be recited in the art, even though element D is not explicitly described as being excluded herein.

When an element or layer is referred to as being "on," "engaged to," "connected to," or "coupled to" another element or layer, it can be directly on, engaged, connected or coupled to the other element or layer, or intervening elements or layers can be present. In contrast, when an element is referred to as being "directly on," "directly engaged to," "directly connected to" or "directly coupled to" another element or layer, there can be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. can be used herein to describe various elements, components, regions, layers and/or sections, these elements, components, regions, layers and/or sections should not be limited by these terms. These terms can be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, can be used herein for ease of description to describe one element or feature's relationship to another element(s) or feature(s) as illustrated in the figures. Spatially relative terms can be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

The present technology includes articles of manufacture, systems, and processes that relate to a container 100 for dispensing a liquid 101, as shown in FIGS. 1-5. It should be appreciated that the liquid 101 can be a liquid fuel. The liquid fuel can be gasoline or another flammable fuel. The container 100 can be utilized to dispense gasoline into a gas tank of a lawn and garden engine, such as a lawn mower or a chainsaw. Advantageously, the container 100 of the present disclosure can be utilized to dispense the liquid 101 without an operator lifting the container, as described in greater detail hereinbelow.

The container 100 can include a housing 102. The housing 102 can include a top wall 104, a base 106, and side walls 108. It should be appreciated that the container 100 of the present disclosure can be configured to have a space-saving design. The housing 102 of the container 100 can have an overall cuboid shape, including a substantially uniform rectangular cross-sectional shape, as shown in FIGS. 1-13. A skilled artisan can select other suitable shapes for the housing 102, as desired.

Figure 5:
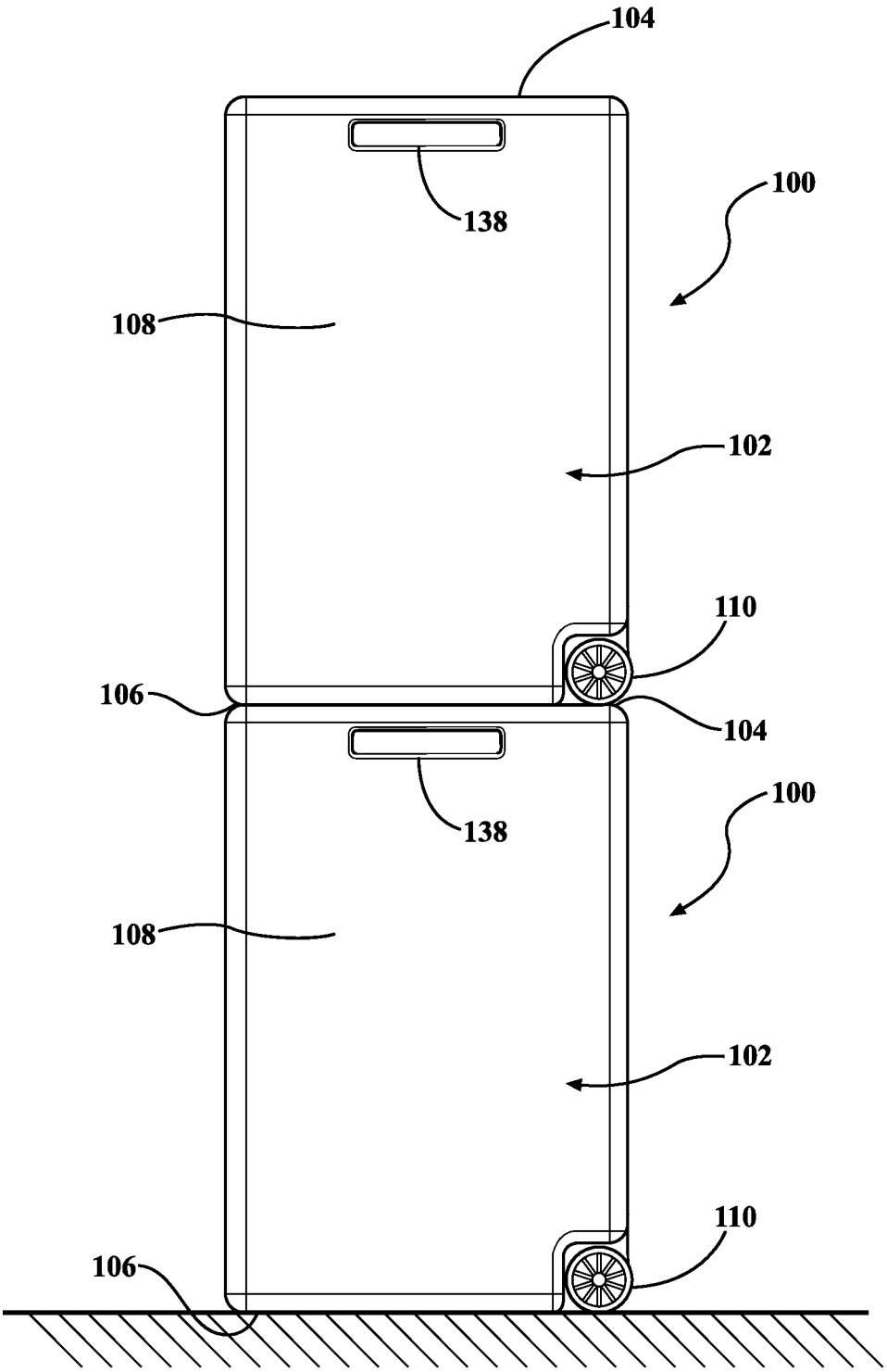
FIG. 5 is a side elevational view of a stack of two of the containers shown in FIG. 1.
Figure 6:
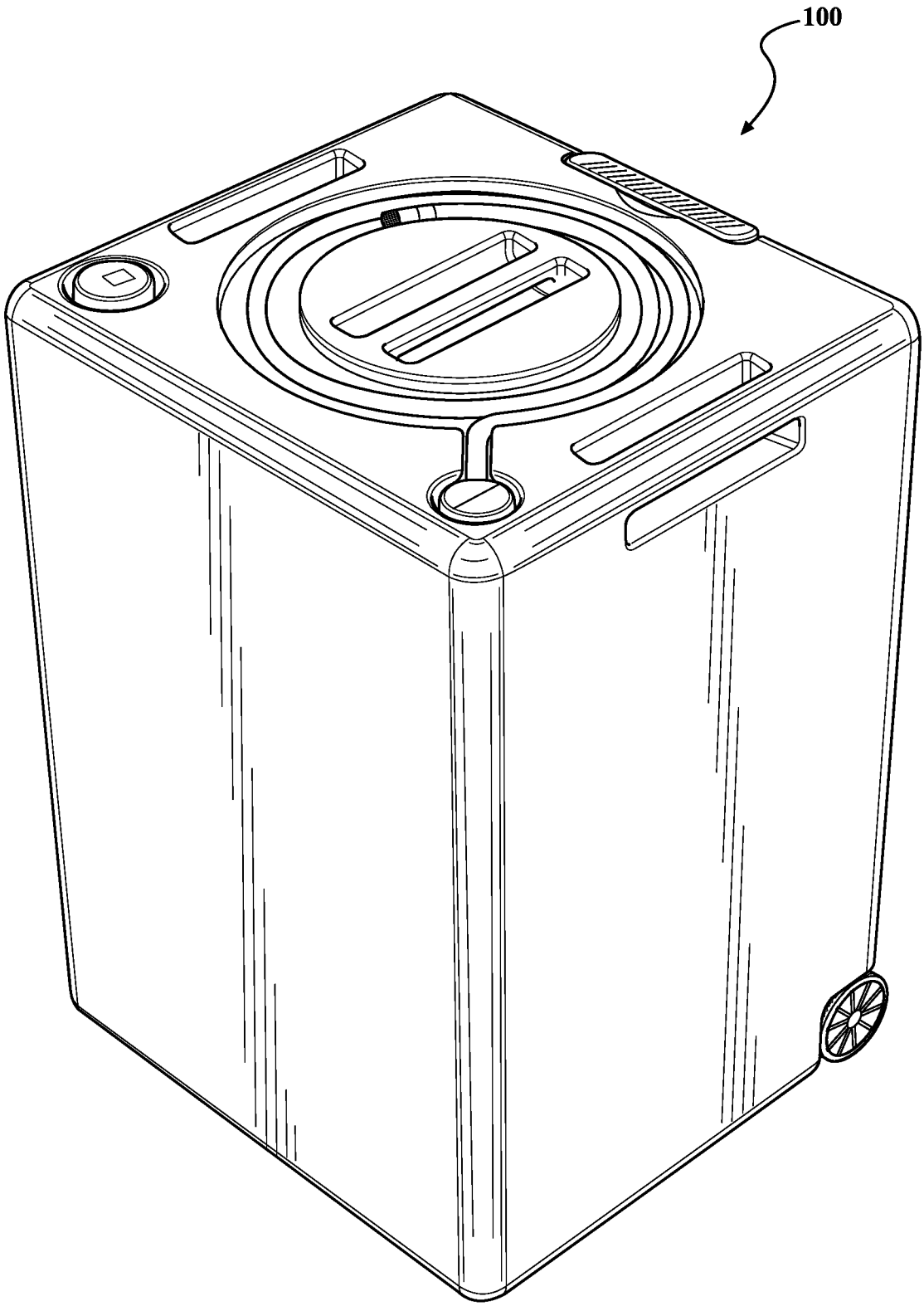
FIG. 6 is a top perspective view of the container, according to another embodiment of the present disclosure.
Figure 8:
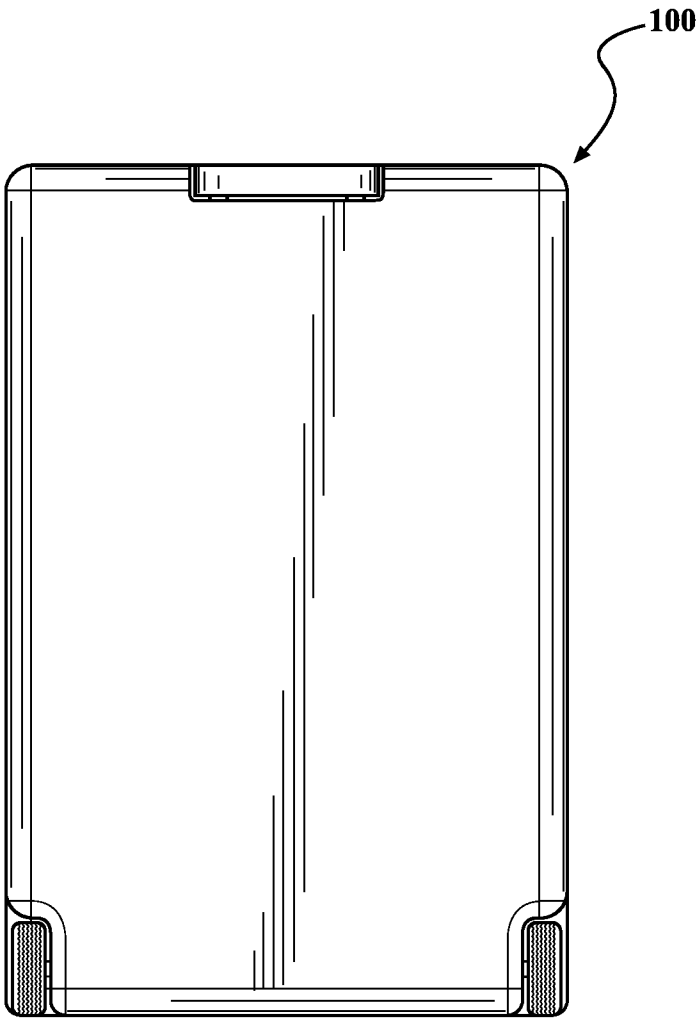
FIG. 8 is a rear elevational view of the container shown in FIG. 6.
Figure 7:
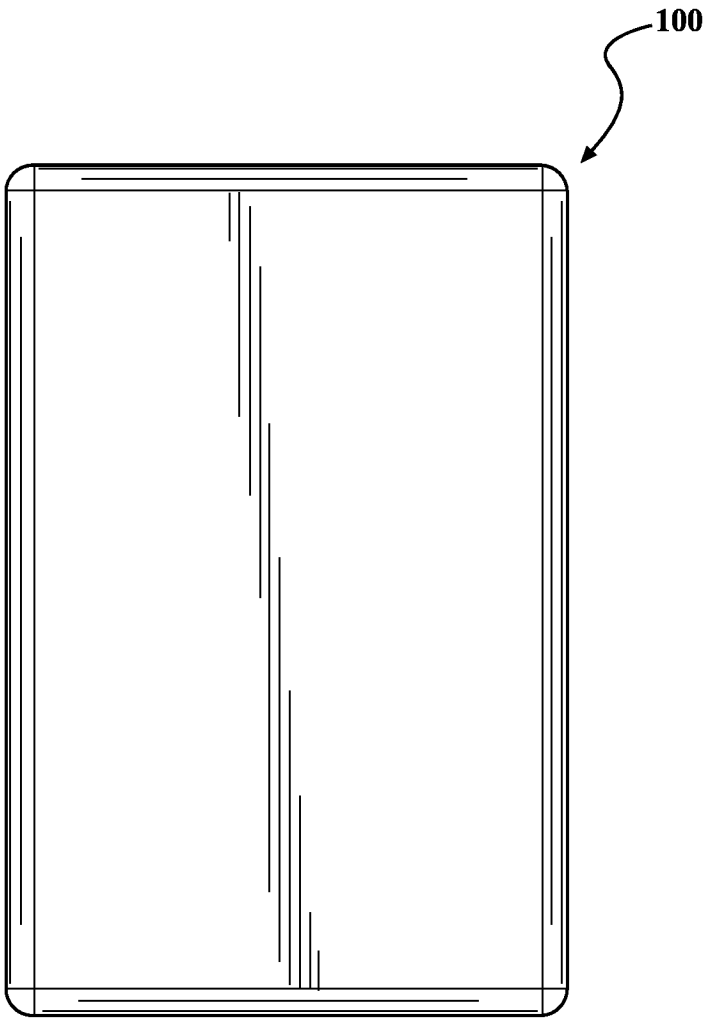
FIG. 7 is a front elevational view of the container shown in FIG. 6.
Figure 10:
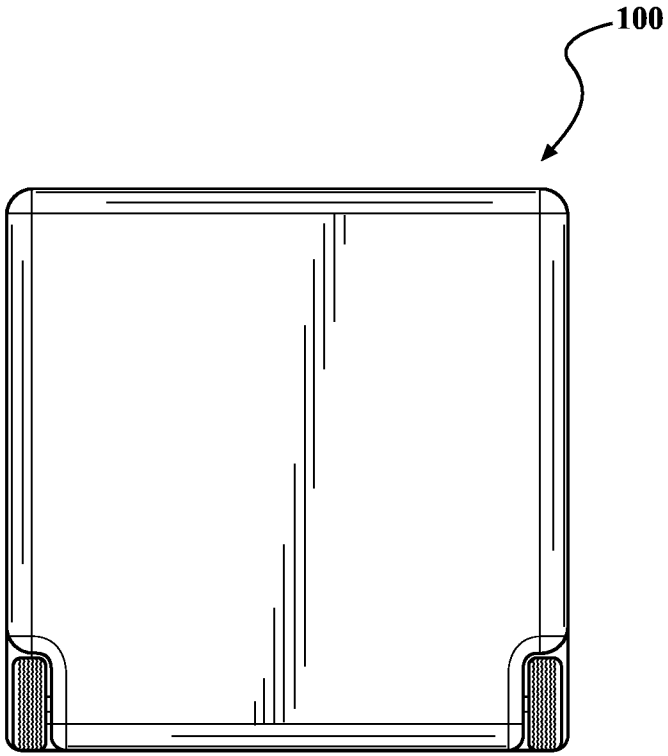
FIG. 10 is a bottom plan view of the container shown in FIG. 6.
Figure 9:
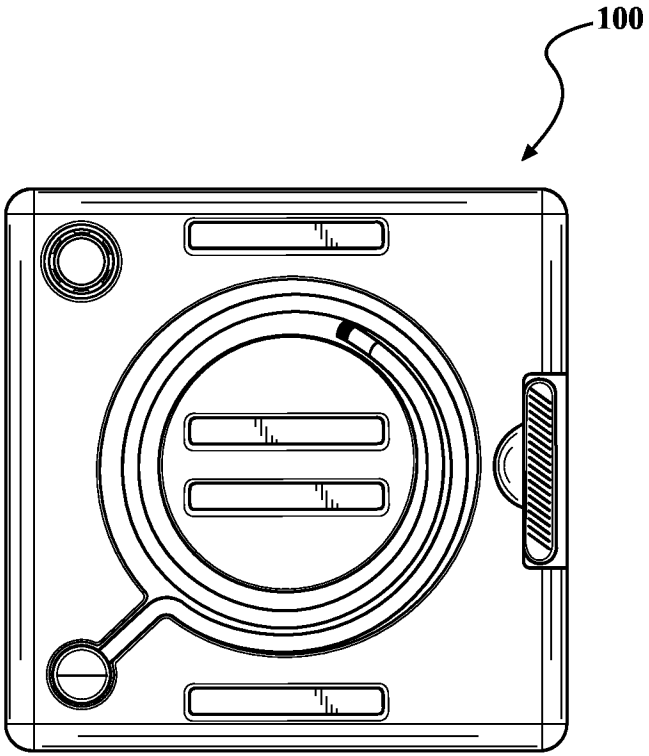
FIG. 9 is a top plan view of the container shown in FIG. 6.
Figure 12:
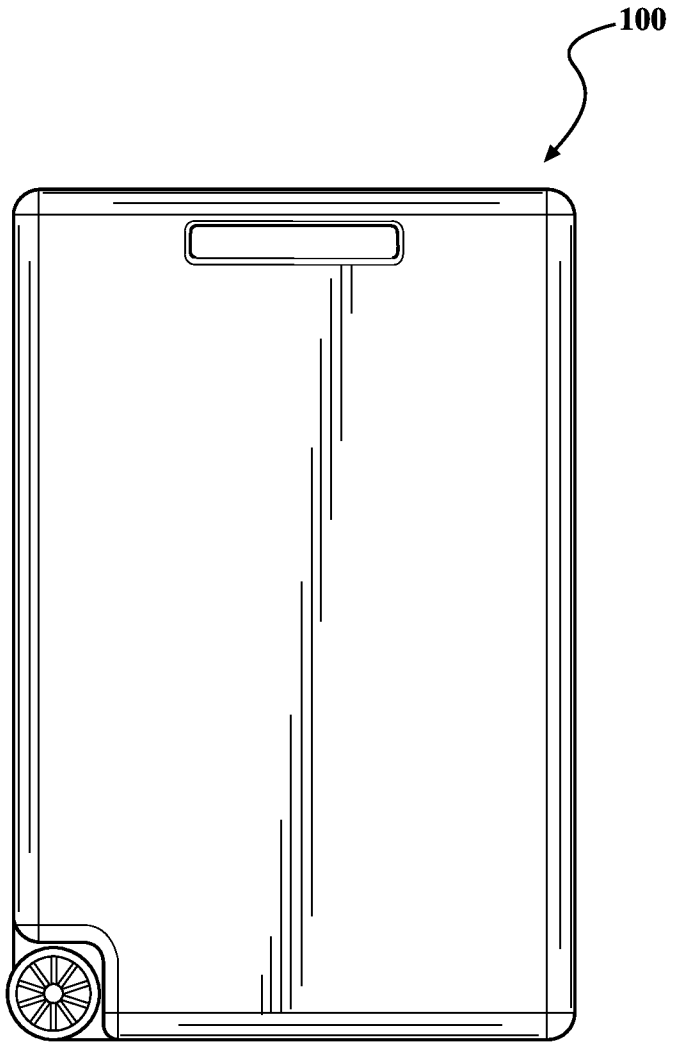
FIG. 12 is a left side elevational view of the container shown in FIG. 6.
Figure 11:
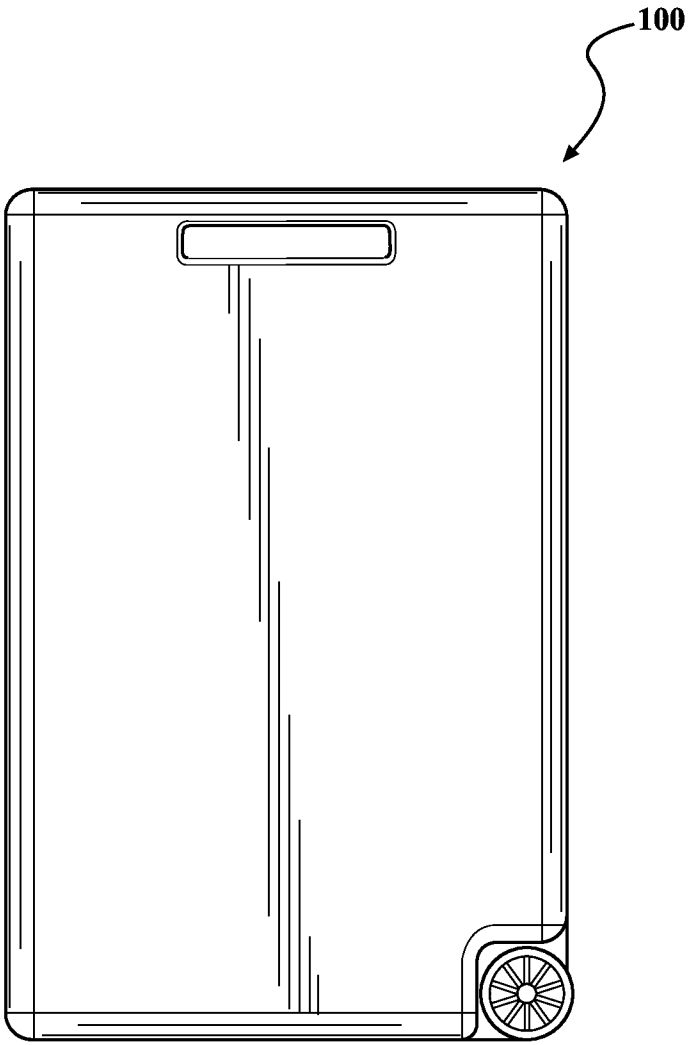
FIG. 11 is a right side elevational view of the container shown in FIG. 6.
Figure 13:
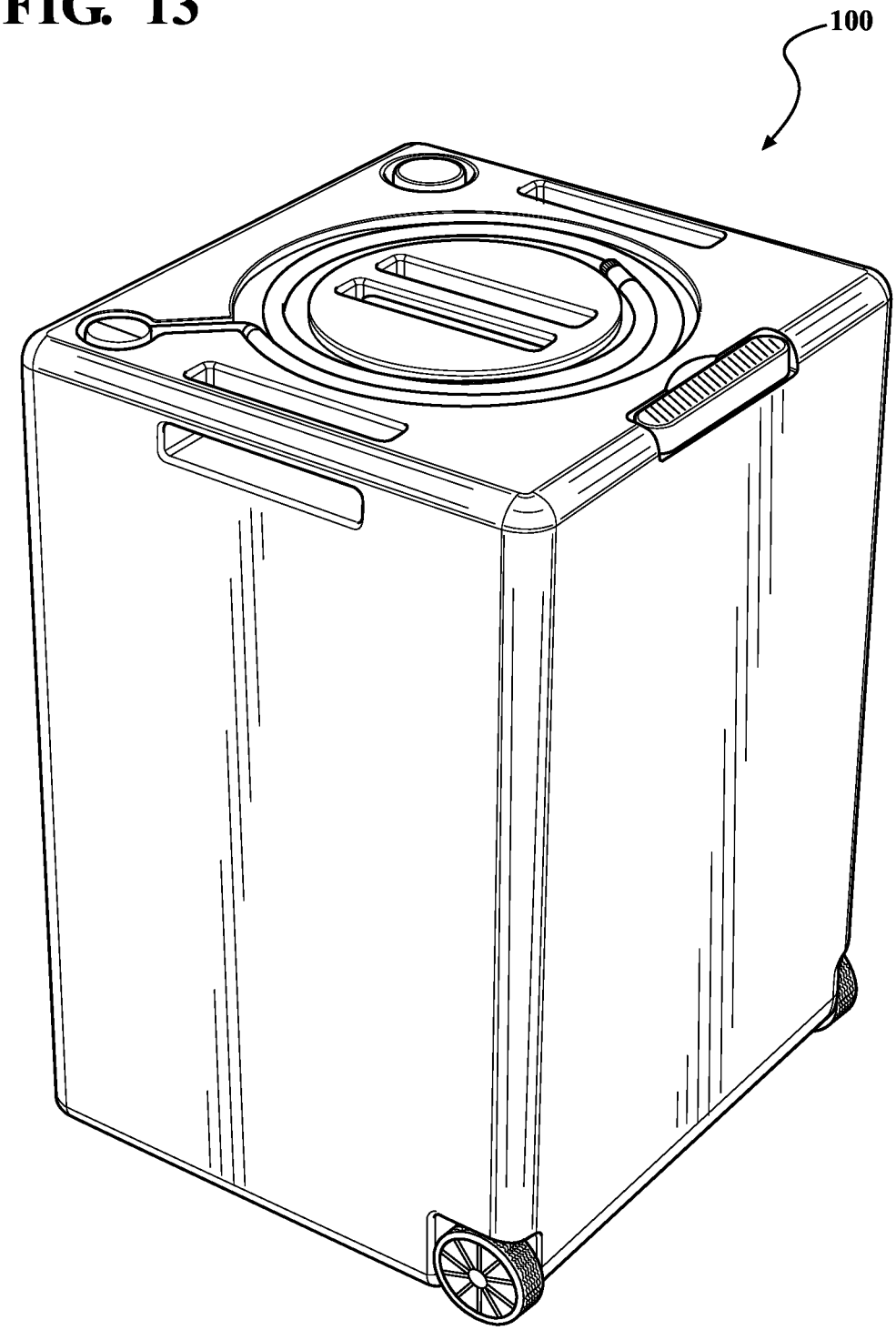
FIG. 13 is a rear perspective view of the container shown in FIG. 6.

It should be appreciated that the container 100 is generally free of any projections. In other words, the container generally does not include features that extend beyond a surface of each of the top wall 104, the base 106, and the side walls 108, as discussed in greater detail hereinbelow. Advantageously, the general lack of projections from the container 100 can allow the container 100 to be more easily stored as the container 100 can easily be stacked or stored in existing shelving, for example, as shown in FIG. 5. Additionally, the general lack of projections also allows for more durability for the container 100, as there are less parts that can be broken off of the container 100 in both use and storage. The container 100 can further include rounded edges formed between the top wall 104, the base 106, and the side walls 108. The rounded edges can allow for further durability of the container 100.

Each of the top wall 104, the base 106, and the side walls 108 can have a thickness that allows for durability and rigidity of the housing 102. In certain embodiments, the housing 102 can be sufficiently durable to be stood on by the operator or to have additional containers 100 stacked on the top wall 104, in operation. A skilled artisan can select a suitable thickness for each of the top wall 104, the base 106, and the side walls 108, and additional parts of the container 100, as desired.

The housing 102 can be fabricated from a material that is light-weight and rigid to allow the container 100 to be both portable and durable. For example, the housing 102, can be formed from a plastic material such as a polyethylene plastic material, as a non-limiting example. The plastic material can allow the housing 102 to be sufficiently insulated and can militate against effects of a storage environment on the housing 102. In one particular non-limiting example, the housing can be formed from high-density polyethylene. Advantageously, high-density polyethylene can sufficiently shield the liquid 101 stored within the housing 102 from heat of the storage environment.

The housing 102 can be formed by a molding process, including blow molding or injection molding, as non-limiting examples. Other ways to form one or more portions of the housing 102 include plastic welding methods alone or in conjunction with various portions formed by blow molding, injection molding, and/or vacuum molding. It should be appreciated that various suitable materials and manufacturing methods for the housing 102 can be employed, as desired.

In certain embodiments, the top wall 104, the base 106, and the side walls 108 can be welded, fused, or glued together at final assembly. A skilled artisan can select other suitable methods for connecting the top wall 104, the base 106, and the side walls 108, as desired. Certain embodiments include where various components can be combined into integrated structures, such as where entireties or portions of the top wall 104, the base 106, and the side walls 108 are commonly molded or formed.

Figure 3:
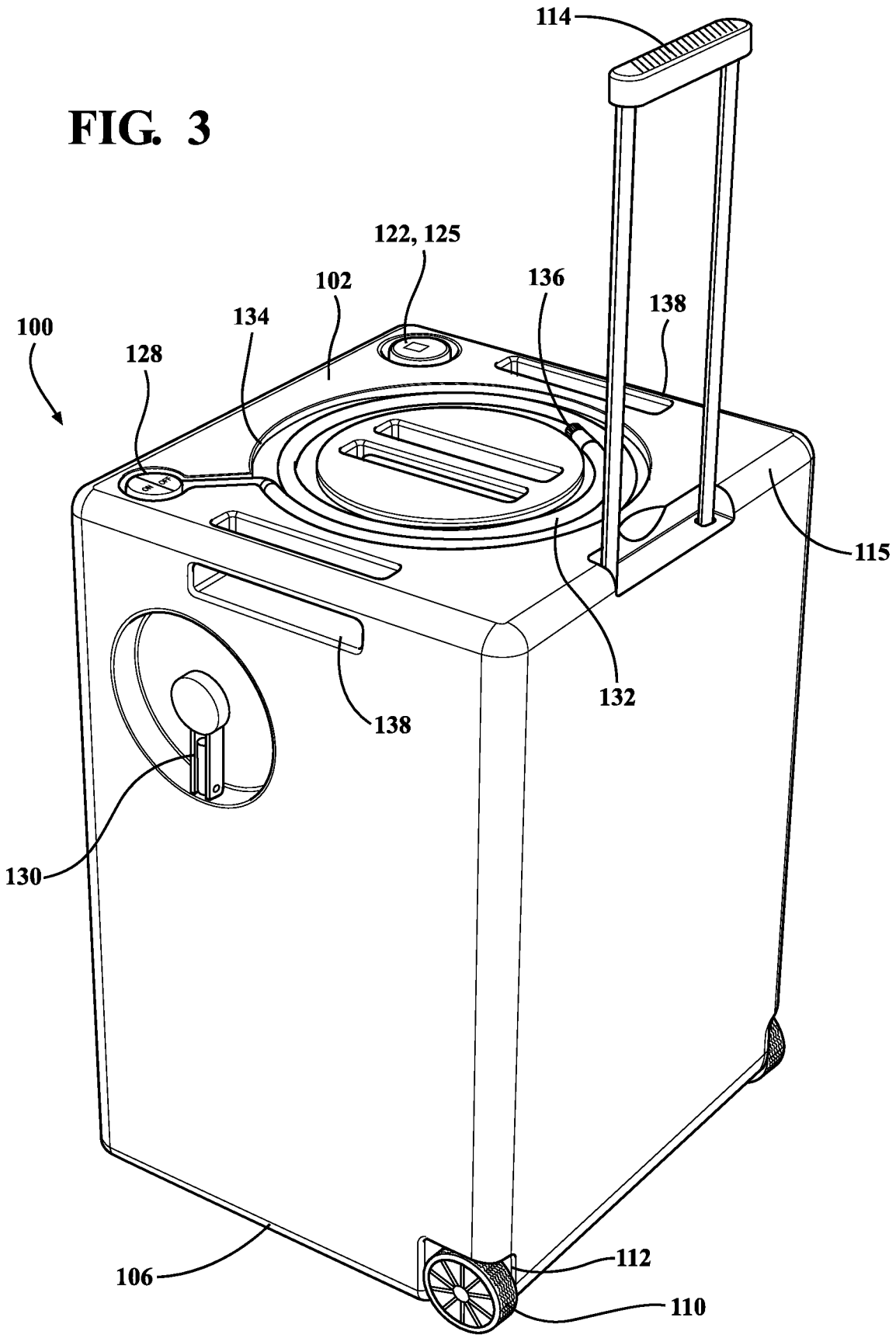
FIG. 3 is a rear perspective of the container shown in FIG. 1, further depicting a handle in a raised position.

The housing 102 can include wheels 110. The wheels 110 can be disposed adjacent to the base 106 and one of the side walls 108. As shown in FIGS. 3 and 5, a wheel well 112 can be formed in two opposite side walls 108. Each of the wheels 110 can be disposed in one of the wheel wells 112. Advantageously, the wheel wells 112 allow the wheels to be flush with the housing 102. In other words, where the wheels 110 are disposed in the wheel wells 112, the wheels 110 do not extend beyond an exterior surface of the side walls 108.

The housing 102 can include a handle 114. The handle can be disposed in an edge 115 formed between the top wall 104 and one of the side walls 108. The handle 114 can be telescopic to allow for the handle to be recessed into the housing when not in use. As shown in FIG. 1, when recessed into the housing 102, the handle 114 can be flush with the edge formed between the top wall 104 and one of the side walls 108. In operation, the operator can use the handle to tilt the housing 102 about the wheels 110. Advantageously, the wheels 110 and the handle 114 can allow the operator to transport the container 100 without having to lift the container.

The top wall 104, the base 106, and the side walls 108 can define a hollow interior 116 of the container 100. The hollow interior 116 can include a reservoir 118 and a pump 120. The reservoir 118 can hold the liquid 101 within the container 100. The reservoir 118 can be in communication with an exterior of the container 100 through an inlet 122 and an outlet 124 formed in the top wall 104. The inlet 122 can allow the operator to fill the reservoir 118 with the liquid 101. The inlet 122 can include a lid 125. Each of the inlet 122 and the lid 125 can include a threaded section (not shown) to secure the lid 125 to the inlet 122 to militate against spills or undesirable access to the liquid by children or animals. It should be appreciated that each of the inlet 122 and the outlet 124 can be formed in the top wall 104 opposite of the handle 114.

As shown in FIGS. 1-4, the inlet 122 can be recessed from a surface of the top wall 104. Accordingly, neither the inlet 122 nor the lid 125 when disposed on the inlet 122 extend past the surface of the top wall 104. Advantageously, the inlet 122 and the lid 125 being recessed from the surface allows the surface of the top wall 104 to be flat, which can allow for multiple containers 100 to be stacked.

Figure 4:
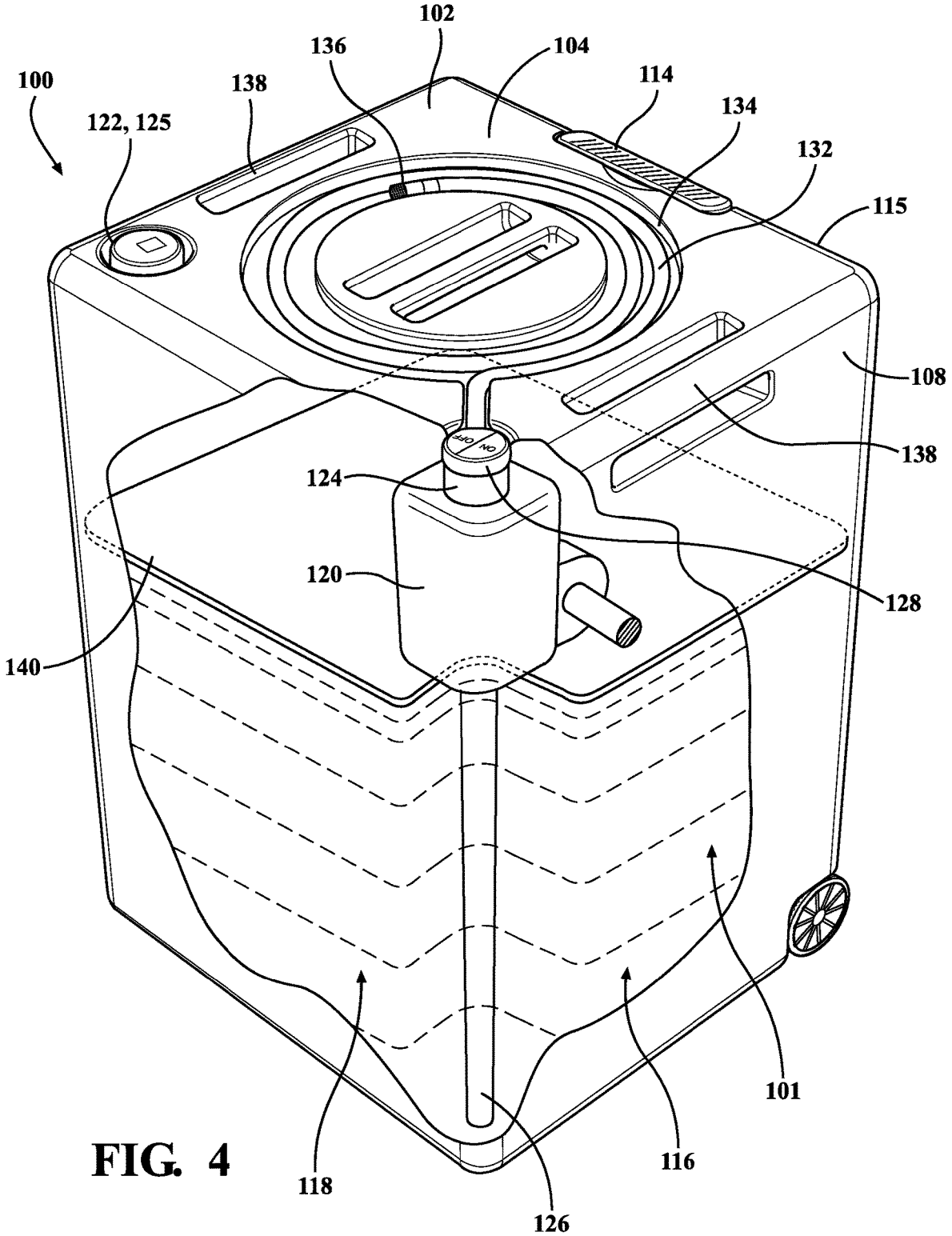
FIG. 4 is a front perspective view of the container of FIG. 1, further depicting a cutout portion to illustrate internal components of the container.

With renewed reference to FIGS. 1 and 4, the pump 120 can be in communication with the reservoir 118 and the outlet 124. In particular, the pump 120 can be configured to move the liquid 101 from the reservoir 118 through the outlet 124 to the exterior of the container 100 for a predetermined final use of the liquid 101.

The pump 120 can be mounted within the hollow interior 116 of the container 100. In certain examples, the pump 120 can be mounted in a corner 127 of the hollow interior 116 of the container 100. The pump 120 can be disposed adjacent to the top wall 104 in the hollow interior 116 of the container 100. The outlet 124 can be formed in the top wall 104 substantially above the pump 120. The pump 120 can be mounted in an external casing that is co-formed with the adjacent side walls 108. In other embodiments, the pump 120 can be mounted to the adjacent side walls 108 via an adhesive or one or more mechanical fasteners, such as bolts or screws, as non-limiting examples. Advantageously, the pump 120 can be mounted above the reservoir 118, which can militate against undesirable contact between an exterior of the pump 120 and the liquid 101.

The pump 120 can include a power source (not shown) and a liquid inlet 126. The liquid inlet 126 can be configured to move the liquid 101 from the reservoir 118 to the pump 120. The liquid inlet 126 of the pump 120 can extend from the pump 120 to the reservoir 118 of the hollow interior 116 of the container 100. The liquid inlet 126 can extend from the pump 120 to adjacent to the base 106 in the hollow interior 116 of the container 100. Advantageously, the liquid inlet 126 of the pump 120 can collect the liquid 101 regardless of a level of the liquid 101 since the liquid inlet 126 pulls the liquid from adjacent the base 106. Accordingly, as the level of the liquid 101 lowers in use, the liquid inlet 126 can continue to fluidly couple the liquid 101 to the pump 120.

The pump 120 can be an electric pump. The mechanical pump can include batteries as a power source, as one non-limiting example. The mechanical pump can be actuated by a button 128. The mechanical pump can likewise be turned off by the button 128. The button 128 can be disposed in the top wall 104 above the pump 120. It should be appreciated that the button can be formed such that it does not extend passed the surface of the top wall 104. In particular, the button 128 can be disposed at the outlet 124. Advantageously, the mechanical pump and the button can allow the operator to easily pump the liquid from the container 100 to the desired end use.

In certain examples, the pump 120 can be configured for manual operation and can include a crank handle 130, for example, as shown in FIG. 1-4. The crank handle 130 can be used to provide power to the pump 120, in operation, as a manual override to the power source. If the pump 120 experiences power failure, the operator can use the crank handle 130 to power the pump 120. In certain other examples, the pump 120 can be a manual pump that is solely powered by the crank handle 130. The operator can utilize the crank handle 130 to actuate the pump 120, as required. It should be appreciated that a skilled artisan can select other suitable pump types and power sources for the pump 120, within the scope of this disclosure.

The crank handle 130 can be disposed on one of the side walls 108. The crank handle 130 can be foldable so that it can be stored within the sidewall 108, for example, as shown deployed in FIG. 1 and folded and stored in FIGS. 2-3. The operator can deploy the crank handle 130 when the crank handle 130 is required. The operator can then fold the crank handle 130 back into the side wall 108 for storage. Advantageously, the foldability of the crank handle 130 can allow the crank handle 130 to be stored such that it does not extend beyond the surface of the side wall 108, which can limit an amount of protruding parts of the container 100.

With renewed reference to FIG. 4, the outlet 124 can be in fluid communication with a hose 132. The hose 132 can be configured to receive the liquid 101 that is pumped through the outlet 124. The hose 132 can be fabricated from a flexible plastic material. The flexible plastic material can allow the operator to more easily position the hose 132 for the desired end use, as needed. In certain other embodiments, the hose 132 can be retractable. The hose 132 can also be reversibly coupled to outlet 124, allowing the hose 132 to removed, replaced, or fitted with different types of hose 132 including different lengths of hose 132. A skilled artisan can select a suitable flexible plastic material for the hose 132, as desired.

The hose 132 can be stored in an annular recess 134, as shown in FIGS. 1-4. The annular recess 134 can be formed within the top wall 104 of the housing 102. The hose 132 can be coiled within the annular recess 134 for storage. Advantageously, the annular recess 134 allows the hose 132 to be stored without extending passed the surface of the top wall 104. Accordingly, while the hose 132 is stored, the top wall 104 can have a substantially planar surface.

In certain embodiments, the hose 132 can include a nozzle tip 136. The nozzle tip 136 can be disposed on a free end of the hose 132. The nozzle tip 136 can allow for accurate placement of the liquid 101, in operation. The nozzle top 136 can include various safety features. For example, the nozzle tip 136 can include flow limitation devices, which can limit the amount of liquid that can flow through the nozzle tip 136 over a period of time. The nozzle tip 136 can include a sensing device that can stop the pump 120 when a certain fuel level is sensed. For example, where filling an external gas tank, the nozzle tip 136 can sense when the external gas tank is full, and stop the pump 120, which can militate against spillage of the liquid 101.

The housing 102 can include one or more grab handles 138. The grab handles 138 can allow the operator or operators to lift and/or position the container 100, as needed, by providing a hand grip. Certain grab handles 138 can be disposed within an edge formed between the top wall 104 and one of the side walls 108. Accordingly, the grab handles 138 do not extend outwardly from the housing 102. One of the grab handles 138 can be formed in a portion of the top wall 104 that is circumscribed by the annular recess 134.

The container 100 can further include one of more vapor mitigation devices. The vapor mitigation devices can be utilized to minimize an amount of vapor of the liquid 101 that can be formed within the hollow interior 116 of the housing 102. Advantageously, the vapor mitigation devices can decrease the buildup of vapors within the container 100. In one non-limiting example, as shown in FIG. 4, the vapor mitigation device can be a float 140. The float 140 can be configured to rest on a surface of the liquid 101 within the container 100, and move automatically with the liquid level as the liquid 101 is dispensed. The float 140 can minimize a volume of air between the surface of the liquid 101 and the top wall 104 of the container, and thus, limit the volume, in which, vapors can be formed. In another non-limiting example, the vapor mitigation device can be a bladder. In particular, the reservoir 118 can be configured as the bladder. The bladder can be configured to store liquid. As liquid is removed from the bladder, air is also removed. Thus, the volume, in which vapors can be formed is limited. A skilled artisan can employ other suitable vapor mitigation devices, as needed.

Figure 14:
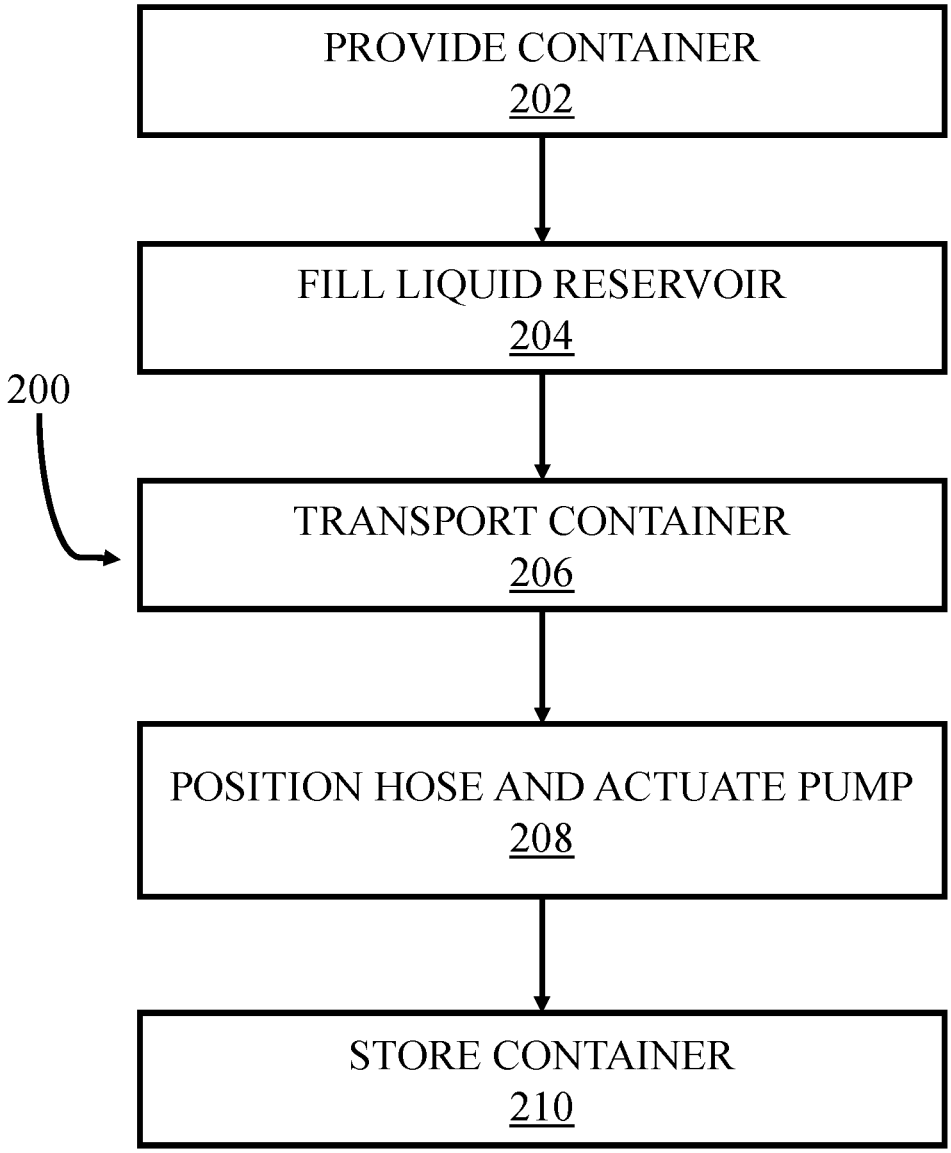
FIG. 14 is a flow chart depicting a method of operating a container, according to a further embodiment of the present disclosure.

The present disclosure further includes a method 200 of operating the container 100, for example, as shown in FIG. 14. The method 200 can include a first step 202 of providing the container 100 as described herein. A second step 204 can be filling the reservoir 118. In particular, the reservoir 118 can be filled through the inlet 122.

The method 200 can include a third step 206 of transporting the container 100 to the desired location. This third step 206 can be performed by utilizing the wheels 110 and the handle 114 to move the container 100. Alternatively, the operator can lift the container 100 using one of the grab handles 138. A fourth step 208 of the method can be positioning the hose 132 and actuating the pump 120 to pump the liquid to the desired location, such as the gas tank of a lawn mower.

The method 200 can include a fifth step 210 of storing the container 100 after use. As described in greater detail hereinabove, the container is configured to be stackable, which can allow for easy storage in existing shelving. Multiple containers 100 can be easily stacked to provide further storage options.

Advantageously, the container 100 of the present disclosure can allow the operator to easily transport, store, and use the container 100. The container 100 is stackable and portable, which can improve the ease of use. The container 100 is substantially free of projections, which can improve the overall durability of the container 100.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A container for dispensing a liquid, comprising:

a housing, including a top wall, a base, and side walls, which form a substantially cuboid shape having a substantially uniform rectangular cross-section, the housing further including wheels and a telescopic handle, the wheels are disposed within wheel wells formed in opposite side walls of the housing, the wheel wheels are recessed from a surface of each of the side walls and the wheels are flush with an exterior surface of each of the side walls, the handle is disposed in an edge formed between the top wall and one of the side walls, and the handle is configured to recess into the side wall;

a reservoir forming a portion of an interior of the housing, the reservoir configured to store the liquid;

an outlet formed in the housing and fluidly coupled to the reservoir; and a pump disposed in the interior of the housing, the pump operable to transfer the liquid between the reservoir and the outlet; and a hose in fluid communication with the outlet, the hose configured to be stored in an annular recess formed in the top wall, wherein the housing includes an inlet formed in the top wall, the inlet and the outlet formed in opposite corners of the top wall, the inlet recessed in the top wall of the housing, and an uppermost surface of the top wall includes a majority of the top wall and is planar.

2. The container of claim 1, wherein the housing is formed from a polyethylene plastic material.

3. The container of claim 1, wherein the housing includes an inlet formed in the top wall and the inlet and outlet are formed in opposite corners of the top wall along a shared side wall.

4. The container of claim 1, wherein the pump includes one of an electric pump and a manual pump.

5. The container of claim 1, wherein the pump is powered by a crank handle that is disposed on one of the side walls.

6. The container of claim 1, wherein the hose includes a nozzle tip disposed on a free end of the hose.

7. The container of claim 1, wherein the housing includes a grab handle formed between the top wall and one of the side walls.

8. The container of claim 1, further comprising a vapor mitigation device disposed in the reservoir.

9. A plurality of containers for dispensing liquid, wherein each container comprises a container according to claim 1, wherein a first one of the containers is stacked on the top wall of a second one of the containers.

10. The container of claim 1, wherein the inlet is connected to the annular recess via a recessed channel disposed in the top wall.

11. A method of operating a container for dispensing a liquid, comprising:

providing the container including a housing, including a top wall, a base, and side walls, which form a substantially cuboid shape having a substantially uniform rectangular cross-section, the housing further including wheels and a telescopic handle, the wheels are disposed within wheel wells formed in opposite side walls of the housing, the wheel wheels are recessed from a surface of each of the side walls and the wheels are flush with an exterior surface of each of the side walls, the handle is disposed in an edge formed between the top wall and one of the side walls, and the handle is configured to recess into the side wall; a reservoir forming a portion of an interior of the housing, the reservoir configured to store the liquid; an outlet formed in the housing and fluidly coupled to the reservoir; and a pump disposed in the interior of the housing, the pump operable to transfer the liquid between the reservoir and the outlet, and a hose in fluid communication with the outlet, the hose configured to be stored in an annular recess formed in the top wall, wherein the housing includes an inlet formed in the top wall, the inlet and the outlet formed in opposite corners of the top wall, the inlet recessed in the top wall of the housing, and an uppermost surface of the top wall includes a majority of the top wall and is planar;

filling the reservoir;

transporting the container to a predetermined location;

positioning a hose and actuating the pump; and storing the container.

* * * * *